United States Patent [19]

Ritter

[11] 4,298,055

[45] Nov. 3, 1981

[54] ACTUATED SECTOR PLATE

[75] Inventor: Kent E. Ritter, Wellsville, N.Y.

[73] Assignee: The Air Preheater Company, Inc., Wellsville, N.Y.

[21] Appl. No.: 181,594

[22] Filed: Aug. 27, 1980

[51] Int. Cl.[3] ..... F28D 19/00

[52] U.S. Cl. ..... 165/9

[58] Field of Search ..... 165/9

[56] References Cited

U.S. PATENT DOCUMENTS

| | | | |
|---|---|---|---|
| 3,785,431 | 1/1974 | Pettersson et al. | 165/9 |
| 4,124,063 | 11/1978 | Stockman | 165/9 |
| 4,206,803 | 6/1980 | Finemore et al. | 165/9 |

*Primary Examiner*—Albert W. Davis

*Attorney, Agent, or Firm*—Wayne H. Lang

[57] ABSTRACT

Rotary regenerative heat exchange apparatus including a cylindrical rotor of heat absorbent material that is alternately exposed to a hot and a cold fluid in order that heat absorbed from the hot fluid may be transferred to the cold fluid passing therethrough. The rotor is surrounded by a housing that includes a sector plate at opposite ends thereof to separate the hot from the cold fluids. As the rotor turns and is being subjected to a wide range of temperatures, it distorts into a dish shaped element. A mechanical toggle arrangement moved by a hydraulic actuator forces the sector plate into a configuration similar to that of the adjacent face of the rotor so as to preclude excessive leakage of fluid therebetween.

7 Claims, 3 Drawing Figures

ACTUATED SECTOR PLATE

BACKGROUND OF THE INVENTION

In rotary regenerative heat exchange apparatus a mass of heat absorbent material is positioned in a hot gas stream to absorb heat from hot gases passing therethrough. After the heat absorbent material becomes heated by the hot gases it is moved to a stream of cooler air or other gas where the then hot material transmits its newly absorbed heat to the cool fluid passing therethrough.

The heat absorbent material is usually carried in a rotor that rotates between the hot and cool fluids, while a fixed housing including sector plates at opposite ends of the rotor is adapted to surround the rotor. To prevent mingling of the hot and cool fluids, the end edges of the rotor are provided with flexible sealing members that rub against the adjacent surface of the rotor housing to resiliently accommodate a limited degree of "rotor turndown" or other distortion caused by mechanical loading or thermal deformation of the rotor.

To permit turning the rotor freely about its axis, certain minimum clearance space between the rotor and adjacent housing is to be desired, however, excessive clearance must be avoided to preclude excessive fluid leakage. Under conditions marked by a rapid change of temperature, however, excessive deformation of the rotor may cause excessive leakage and a reduction in the overall effectiveness of the device, while excessive interference between the rotor and adjacent housing structure may cause excessive wear.

The expansion of the rotor and the adjacent rotor housing assumes the greatest proportions directly adjacent the inlet for the hot fluid where the change in temperature similarly assumes maximum proportions. In accordance with U.S. Pat. No. 4,124,063 the sector plate was forced by a mechanical actuator to assume a dished configuration similar to that of the rotor whereby there would be a minimum of clearance therebetween.

An arrangement disclosed by U.S. Pat. No. 4,206,803 moves the sector plate with a geared actuating rod in response to a particular sensor. This system utilizes a geared actuating rod that is relatively expensive to provide, difficult to install and, moreover, unreliable for continuous operation.

SUMMARY OF THE INVENTION

The present invention accordingly utilizes a sensing means of the type disclosed by U.S. Pat. No. 4,206,803 to actuate a simplified lever-toggle arrangement of the type disclosed herein to apply a force necessary to bend the sector plate into a configuration that matches the rotor. The lever-toggle arrangement has no machined parts so its construction is more rapid and more economical. Moreover, it has fewer parts to maintain so there is less chance of failure and it is thus more reliable for continued operation.

BRIEF DESCRIPTION OF THE DRAWING

Other objectives and the arrangements for achieving these objectives will become more apparent from the specification and drawing in which.

DESCRIPTION OF THE PREFERRED EMBODIMENT

Figure 1:
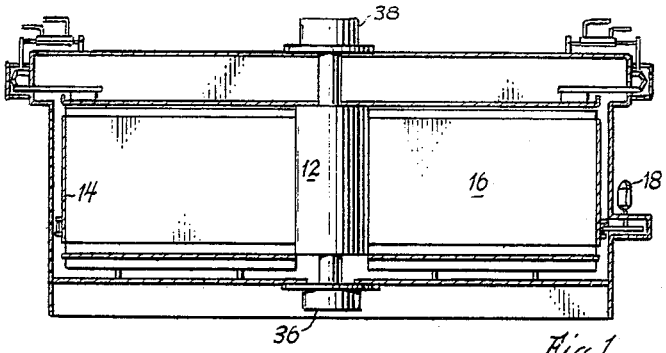
FIG. 1 is a side elevation of a rotary regenerative heat exchange apparatus involving the present invention.

The heat exchanger includes a vertical rotor post 12 and a concentric rotor shell 14 that provides an annular space therebetween to be filled with a mass of heat absorbent element 16. The element mass 16 is rotated by a motor and drive means 18 about its vertical axis whereby it may absorb heat from a heating fluid and then transfer the absorbed heat to a fluid to be heated.

The heating fluid enters the heat exchanger through an inlet duct and then is discharged through an outlet duct after having traversed the heat absorbent element 16 therebetween. In passing over the heated element 16 the cool inlet fluid absorbs heat therefrom and is accordingly discharged as hot fluid before being directed to its place of final use.

A cylindrical housing 28 encloses the rotor to provide an annular space 30 therebetween, while apertured end plates 19 are positioned at opposite ends of the rotor housing to direct the heating fluid and the fluid to be heated therethrough. Sector plates 34 are positioned intermediate opposite ends of the rotor and the end plates to maintain the several fluids in their respective passageways, while radial sealing means 32 are affixed to the end edges of the rotor to preclude the leakage of fluid therebetween.

In most heat exchanger installations, hot gas enters from the top, transferring heat thereof to the material 16 in the rotor before it is discharged as cooled gas through an outlet duct at the bottom of the heater. Conversely, cool air usually enters through a bottom inlet and is exhausted through a suitable outlet after having been in direct contact with the hot element of the rotor. Inasmuch as the inlet for the hot heating fluid and the outlet for the fluid that has been heated customarily lie at the top of the heat exchanger, the top is called the "hot end" while the opposite end of the rotor is commonly termed the "cold end" of the heat exchanger.

The upper end of the rotor is thus subjected to a maximum amount of thermal expansion, while the lower or "cold end" of the rotor is subjected to a much lesser amount. The result of this unequal thermal expansion is to cause rotor deformation that increases the clearance space between the top of the rotor and the surrounding housing structure so as to increase fluid leakage therebetween, thereby lowering the effectiveness of the heat exchanger.

A fixed support bearing 36 at the bottom of the heat exchanger supports the rotor for rotation about its vertical axis, while the upper end of the rotor supports a radial guide bearing 38 that in turn supports the inboard end of each sector plate at a relatively fixed distance from the rotor.

In accordance with U.S. Pat. No. 4,206,803 a geared actuating rod is activated by a sensor that responds to vertical distortion of the rotor. In the present invention the same or similar type sensor is used to activate a hydraulic cylinder 42 that moves a lever forward or backward in response to the flow of hydraulic fluid through lines 52A or 52B, said lever in turn actuating a simplified toggle arrangement that suitably shifts the end plate of the rotor to conform to distortion of the adjacent face of the rotor.

As an amount of fluid under pressure is supplied to cylinder 42 through line 52A, rod 44 is moved to the right, thus similarly moving vertical arm 56 of the bell crank attached thereby to pivot 54. The vertical arm preferably constitutes a pair of upright members which are welded normal to an elongate shaft 58. Opposite ends of shaft 58 are in turn rotatably held by supports 62 affixed to the adjacent housing structure.

Figure 2:
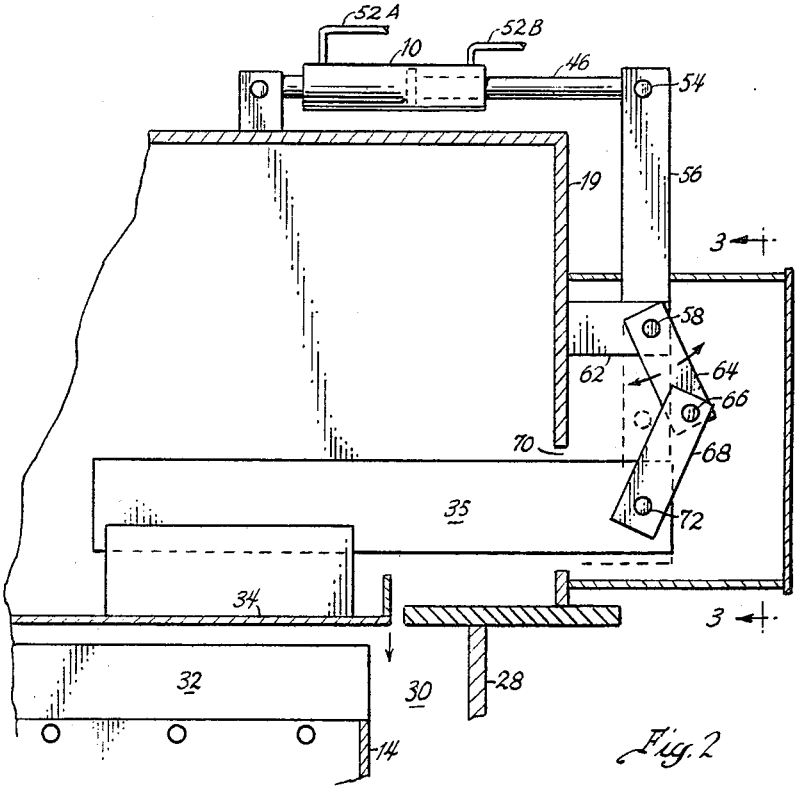
FIG. 2 is an enlarged side view showing the details of a lever actuator for moving the sector plate.
Figure 3:
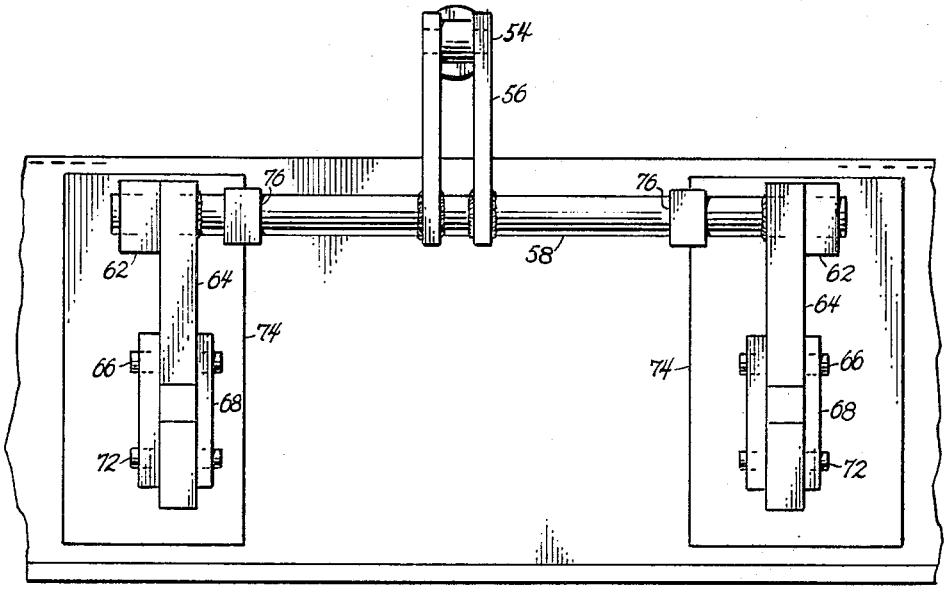
FIG. 3 is an end view showing the lever actuator of FIG. 2 as seen from line 3—3.

A crank arm 64 is welded to each of opposite ends of shaft 58, adjacent the fixed supports 62 as shown in FIG. 3 of the drawing. The crank arm 64 is welded to shaft 58 so as to effect an angle with vertical arm 56 whereby movement of arm 56 from a vertical position will actuate pivot 66 of crank arm 64 arcuately in the manner shown by FIG. 2. A toggle link 68 is movably attached to arm 64 by means of the pivot 66 whereby arcuate movement of toggle link 68 about pivot 72 raises or lowers an extension 35 on the end of sector plate 34 that extends radially through an opening 70 in the outer wall of the end plate 19.

Thus the outer end of the sector plate 34 may be raised or lowered according to arcuate movement of arm 64 about the shaft 58 as effected by fluid flow through lines 52A and 52B.

To preclude fluid leakage into or out of the housing through opening 70, a box type cover 74 is provided for each of said openings, sized to adequately enclose the respective end portions of shaft 58 and the toggle type linkage attached thereto. Sealed bearing means 76 support opposite ends of the shaft 58 as it enters the cover means 74 thereby precluding any fluid leakage into or out of the rotor housing.

I claim:

1. Rotary regenerative heat exchange apparatus having a rotor including a central rotor post and a concentric rotor shell spaced therefrom to provide an annular space therebetween, a mass of heat absorbent material carried in the annular space between the rotor post and the rotor shell, a housing surrounding the rotor in spaced relation including inlet and outlet ducts at opposite ends thereof for a heating fluid and for a fluid to be heated, bearing means at opposite ends of the rotor adapted to support the rotor for rotation about its axis, means for rotating the rotor about its axis, a resilient sector plate intermediate the end of the rotor and the rotor housing adapted to maintain the heating fluid separate from the fluid to be heated, support means that holds the inboard end of the sector plate adjacent the inboard end of the rotor, a toggle type linkage at the outboard end of the rotor for moving the sector plate axially to conform to the configuration of the rotor, said linkage including a bell crank having an upper arm and a lower arm, fixed pivot means at the apex of the upper and lower arms of the bell crank connecting the bell crank to the rotor housing, an elongate link having one end thereof pivotally attached to the sector plate and the other end thereof pivotally attached to the lower arm of the bell crank, and actuating means for moving the upper arm of the bell crank about the fixed point whereby the angle formed by the lower arm of the bell crank and the linkage member may be increased to produce a vertical force component that effectively moves the sector plate vertically toward the adjacent face of the rotor.

2. Rotary regenerative heat exchange apparatus as defined in claim 1 wherein the actuating means includes a hydraulic cylinder that exerts a horizontal force against the upper arm of the bell crank.

3. Rotary regenerative heat exchange apparatus as defined in claim 2 wherein the upper arm of the bell crank is of greater length than the inclined portion thereof to provide a mechanical advantage to the actuating means.

4. Rotary regenerative heat exchange apparatus as defined in claim 3 wherein the resilient sector plate has a position that lies perpendicular to the rotor post.

5. Rotary regenerative heat exchange apparatus as defined in claim 4 wherein the rotor housing has an opening therein outboard from the sector plate, and an extension to said sector plate extending through said opening for attachment to the elongate link.

6. Rotary regenerative heat exchange apparatus as defined in claim 5 including a housing that surrounds said opening to preclude the flow of fluid therethrough.

7. Rotary regenerative heat exchange apparatus as defined in claim 6 including an opening through said housing adapted to permit the toggle type linkage to connect the actuating means to the sector plate.

* * * * *